US009724560B2

(12) United States Patent
Murray et al.

(10) Patent No.: US 9,724,560 B2
(45) Date of Patent: Aug. 8, 2017

(54) COMPRESSIBLE BARBELL ADAPTER

(71) Applicant: Guy Murray, Orleans (CA)

(72) Inventors: Guy Murray, Orleans (CA); Kevin Bailey, Ottawa (CA); Matthew Bailey, Ottawa (CA); John Kim, Ottawa (CA)

(73) Assignee: Guy Murray, Orleans (CA)

( * ) Notice: Subject to any disclaimer, the term of this patent is extended or adjusted under 35 U.S.C. 154(b) by 0 days.

(21) Appl. No.: 14/744,029

(22) Filed: Jun. 19, 2015

(65) Prior Publication Data

US 2015/0297939 A1 Oct. 22, 2015

Related U.S. Application Data

(63) Continuation of application No. 13/944,811, filed on Jul. 17, 2013, now Pat. No. 9,114,279.

(60) Provisional application No. 61/672,671, filed on Jul. 17, 2012.

(51) Int. Cl.

| | |
|---|---|
| ***A63B 21/072*** | (2006.01) |
| ***A63B 23/12*** | (2006.01) |
| ***A63B 21/00*** | (2006.01) |
| ***A63B 21/008*** | (2006.01) |
| *A63B 71/00* | (2006.01) |

(52) U.S. Cl.

CPC ..... *A63B 23/12* (2013.01); *A63B 21/008* (2013.01); *A63B 21/00069* (2013.01); *A63B 21/0724* (2013.01); *A63B 21/148* (2013.01); *A63B 21/1469* (2013.01); *A63B 21/4043* (2015.10); *A63B 21/4045* (2015.10); *A63B 2071/0063* (2013.01); *A63B 2225/09* (2013.01)

(58) Field of Classification Search

CPC ... A63B 21/06; A63B 21/062; A63B 21/0623; A63B 21/0626; A63B 21/072; A63B 21/0722; A63B 21/0724; A63B 21/0726; A63B 21/075; A63B 21/078; A63B 21/00069; A63B 2071/0063; A63B 2225/09; A63B 23/12

USPC ..... 482/92–95, 104, 106–113, 128, 139, 148

See application file for complete search history.

(56) References Cited

U.S. PATENT DOCUMENTS 3,502,326 A * 3/1970 Schaeffer ..... A63B 1/005 403/107
3,545,121 A * 12/1970 Misko ..... A63B 23/12 446/486
3,726,522 A * 4/1973 Silberman ..... A63B 21/0728 285/322
3,938,803 A * 2/1976 Wilmoth ..... A63B 21/05 482/127

(Continued)

*Primary Examiner* — Andrew S Lo

(74) *Attorney, Agent, or Firm* — Loza & Loza, LLP; Razmig H. Messerian

(57) ABSTRACT

A compressible barbell adapter is disclosed, which consists of a compression-retraction member fastened to a hollow shaft for use on a bar. The compression and retraction movement of the compression-retraction member is generally achieved by means of a pinion and a rack system, and can be utilized in conjunction with dampening means. Slidable handles are also connected to the compression-retraction member, and serve to slide along the axis of the hollow shaft, and thus along the bar. The compressible barbell adapter is meant to be fastened onto existing bars or barbells such that additional exertion is focused on the pectoral, deltoid and back muscles during various exercises.

12 Claims, 20 Drawing Sheets

(56) References Cited

U.S. PATENT DOCUMENTS 4,618,142 A * 10/1986 Joseph, Jr. ..... A63B 5/20 482/106
4,775,149 A * 10/1988 Wilson ..... A63B 21/022 482/126
4,822,035 A * 4/1989 Jennings ..... A63B 21/0724 482/106
4,838,542 A * 6/1989 Wilkinson ..... A63B 23/14 482/108
4,913,417 A * 4/1990 Francu ..... A63B 23/14 482/128
4,978,122 A * 12/1990 Dibowski ..... A63B 21/0724 482/106
5,152,731 A * 10/1992 Troutman ..... A63B 21/0724 482/106
5,628,713 A * 5/1997 Wilkinson ..... A45B 3/00 482/51
6,672,573 B2 * 1/2004 Berton ..... E04H 9/02 267/136
7,108,636 B1 * 9/2006 Garcia ..... A63B 21/1627 482/139
8,506,460 B2 * 8/2013 Seitzer ..... A63B 21/4015 482/106
8,672,815 B1 * 3/2014 Springer ..... A63B 21/0724 482/106
2002/0128127 A1 * 9/2002 Chen ..... A63B 21/0726 482/106
2005/0101453 A1 * 5/2005 Jeneve ..... A63B 21/015 482/106
2006/0276314 A1 * 12/2006 Wilson ..... A63B 21/015 482/106
2007/0203002 A1 * 8/2007 Webber ..... A63B 21/078 482/104
2008/0045389 A1 * 2/2008 Bruce ..... A63B 21/0087 482/112
2008/0076636 A1 * 3/2008 Smith ..... A63B 69/004 482/1
2009/0197745 A1 * 8/2009 Olson ..... A63B 21/0728 482/107
2010/0190618 A1 * 7/2010 Chen ..... A63B 21/075 482/108
2012/0094812 A1 * 4/2012 Smiley ..... A63B 21/0004 482/128
2012/0165165 A1 * 6/2012 Iankov ..... A63B 71/0608 482/106
2013/0035218 A1 * 2/2013 Wierszewski ..... A63B 21/4035 482/106
2013/0059696 A1 * 3/2013 Hijmans ..... A61H 1/0274 482/8
2013/0184129 A1 * 7/2013 Lovegrove ..... A63B 21/0724 482/107
2013/0196830 A1 * 8/2013 Pfitzer ..... A63B 21/0602 482/110
2013/0296145 A1 * 11/2013 Tomaszewski ..... A63B 21/06 482/106
2014/0274596 A1 * 9/2014 Krull ..... A63B 21/0724 482/107

* cited by examiner

COMPRESSIBLE BARBELL ADAPTER

CLAIM OF PRIORITY

The present application for patent is a continuation of U.S. patent application Ser. No. 13/944,811 entitled "Compressible Barbell Adapter" filed Jul. 17, 2013 which claims priority to U.S. Provisional Patent Application No. 61/672,671 entitled "Compressible Barbell Adapter" filed Jul. 17, 2012, the entire disclosure of which is hereby expressly incorporated by reference herein.

BACKGROUND

Field

The present invention relates to the field of exercise devices, and more specifically to adapters for bars with compressible and retractable shafts.

Background

Personal training has become increasingly popular in the last decade. Sophisticated training equipment is continuously devised, and new methods of isolating muscles or increasing cardiovascular fitness are always being developed and refined. In particular, many devices attempt to focus on pectoral muscles, such as chest press or chest fly machines. In these machines, a user sits on said machine and pushes outward on handles connected to weights by means of rods or cables. In other exercise machines, such as machine-assisted bench presses, a user lies down and lifts a bar of weight, guided along rails.

Many devices, and in particular barbells, have been devised in order to increase the amount of work done by the pectoral muscle during a chest press, and the total area of the muscle affected by the exercise. Specifically, U.S. Pat. No. 4,775,149 (Wilson), U.S. Pat. No. 6,022,300 (Hightower), U.S. Pat. No. 7,086,999 (Jeneve et al.), U.S. Pat. No. 7,862,486 (Watson) and U.S. Pat. No. 7,892,158 (Varga) disclose various types of rods or barbells to further provide a work out for pectoral muscles.

In particular, Watson and Hightower disclose a barbell with rotating handgrips. The rotational handgrips are utilized in order for a user to further increase muscle building, as it provides pronation and supination motion to increase load on wrists, elbows and forearms. The main issue with said devices is that they cannot provide any additional load to the inner pectoral muscles as well to the deltoids and back. Indeed, the rotating handles simply affect the pronation and supination motion which in turn affects forearms, wrists and elbows. If additional, concentrated work needs to be done to the pectoral, deltoid and back muscles, this is not possible with these devices.

Other devices such as disclosed by Varga, Wilson and Jeneve et al. can fix the aforementioned issues, as they each disclose a rod and barbell with slidable handles along its shaft. Varga's device specifically discloses a tube with slidable handles, meant to be utilized in order to increase the difficulty of pushups with respect to pectoral muscles. A user positions himself or herself for a pushup, with hands on the handles. The handles can then slide along the tube by means of linear bearing assemblies. Wilson discloses a shaft, also with slidable handles in between sets of coiled springs. A user grips onto the handles of the shaft, and slides the handles laterally along the axis of the shaft, engaging the coiled springs such that a more complete muscle workout is achieved. Although not specifically meant to be utilized as a barbell, the slidable handles add additional pressure onto the pectoral muscles. Jeneve et al. discloses a barbell with weight attachment means, meant to be utilized for bench presses, with slidable handles along its shaft. Indeed, as user lies down with the barbell and weights onto the weight attachment means, when performing a chest press, the user can slide the handles laterally along the axis of the shaft in order to further increase resistance to pectoral muscles.

Unfortunately, while Varga, Wilson and Jeneve's devices can provide a further work out to the pectoral muscles, they each have problems that need to be overcome. Specifically, Wilson's bar cannot support weight, such that it can simply be used for stretching and light exercise purposes. Arguably, even if weight attachment means were present, the weights would cause a possible imbalance on the barbell as the user would struggle to slide the handles along the coiled springs. The coiled springs would not necessarily compress or retract in a mirrored fashion, causing the weight to tip on one side or another and render this device ineffective. Meanwhile, Varga's device is again not suited for weights. The device simply supports the upper body weight of a user, and uses a bearing system to slide the handles along the axis of the tube. Since it is not designed to support weight, the bearing system would provide the same faults as Wilson's device, as the bar would never be able to balance itself and would tilt one way or another, causing injury. Finally, Jeneve' s device consists of a barbell with weight attachment means, specifically designed for a bench press workout whereby the handles slide along the axis of the barbell. Jeneve uses a cable/belt and pulley system, such that there are four pulleys within the bar itself and the handles consequently remain equidistant from one another. A first, wider tube is telescopically fitted within a second, narrower tube that encompasses the belt and pulley system. This system's pulley system is not sturdy and can cause problems when a user is using it in an exercise room. Further, while the patent discloses a damper system, it does not state how this system would work or be implemented with a pulley barbell. Jeneve' s device also may be difficult to fix or replace as there are many moving parts within it.

Overall, all five enumerated patents have problems that need to be overcome in order for a device to properly incorporate slidable handles to adequately work out pectoral, deltoid and back muscles. The present device can overcome all of these issues, while using a completely different type of compression-retraction means that will be further explained below.

SUMMARY

In a first aspect, the present invention provides a compressible barbell adapter comprising: a hollow shaft for receiving a bar; a compression-retraction member connected to the shaft; and, slidable handles operatively connected to the compression-retraction member, allowing for the slidable handles to slide along the hollow shaft.

In a second aspect, the present invention provides a method of using a compressible barbell adapter comprising the steps of: sliding a hollow shaft of the compressible barbell adapter onto an existing bar; securing the compressible barbell adapter onto an existing bar by means of securing means; and moving slidable handles of the compressible barbell adapter along the hollow shaft.

According to one aspect, the upper tube is operatively connected to the exit port through an upper lock nut and a J-tube. According to another aspect, the lower tube is operatively connected to the entry port through a lower lock nut and an L-tube. According to yet another aspect, the water recycling unit and/or the mobile water recycling unit further comprises a check valve to allow water to pass through the pump.

According to one aspect, the water recycling unit and/or the mobile water recycling unit further comprises a check valve to preserve water in the pump. According to another aspect, the filter further comprises a filter element to filter smaller debris. According to yet another aspect, the filter further comprises a filter cage to filter larger debris.

According to one aspect, the pump is non-submersible. According to another aspect, the pump is submersible.

BRIEF DESCRIPTION OF THE DRAWINGS

It will now be convenient to describe the invention with particular reference to one embodiment of the present invention. It will be appreciated that the drawings relate to one embodiment of the present invention only and are not to be taken as limiting the invention.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

Figure 1:
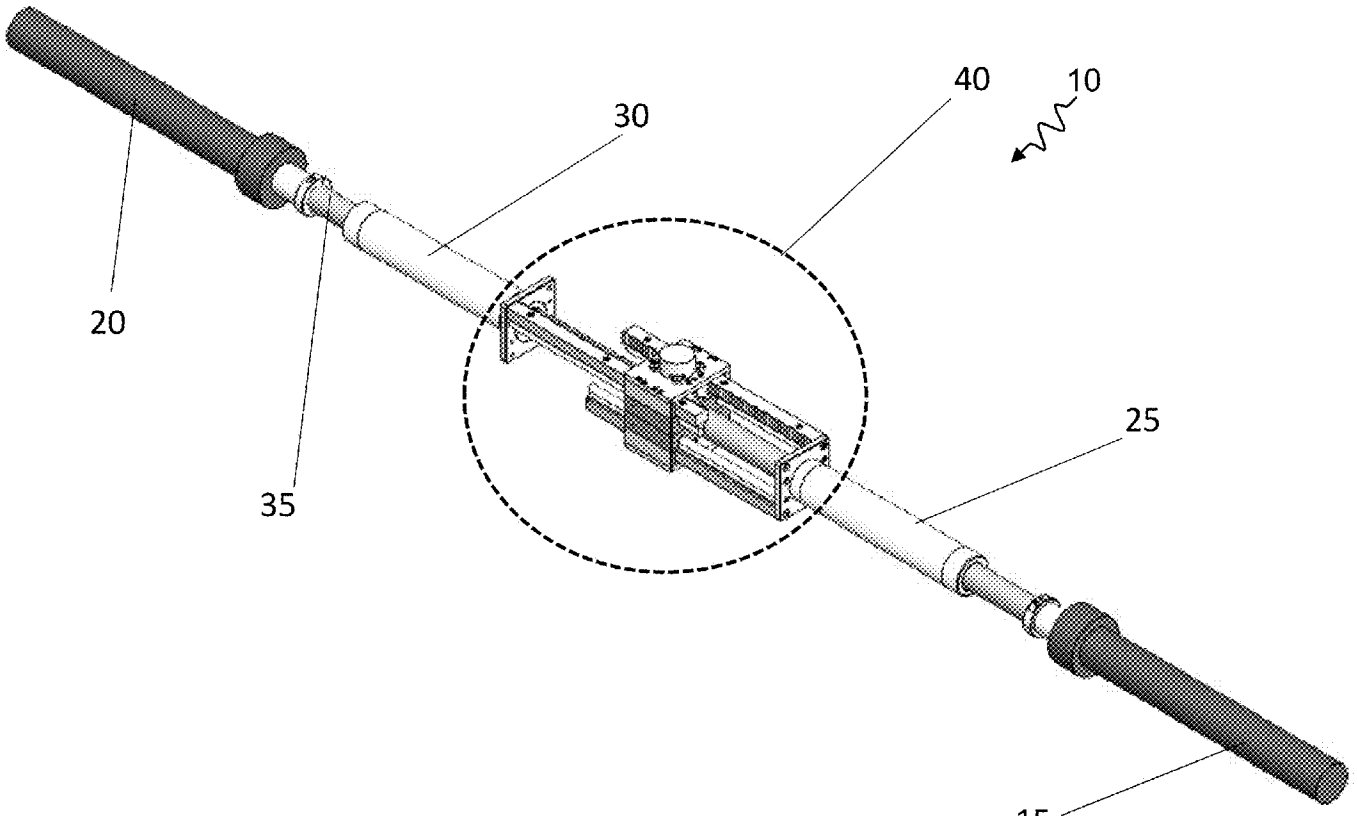
FIG. 1 is a perspective view of a compressible barbell adapter, according to one embodiment of the present invention.

With reference to FIG. 1, a compressible barbell adapter 10 is shown. The compressible barbell adapter 10 is primarily comprised of first and second slidable handles 25, 30, a hollow shaft 35 and a compression-retraction member 40. The compressible barbell adapter 10 can be slid onto an existing bar (not shown) comprised of first and second weight attachment means 15, 20. The installation of the compressible barbell adapter 10 onto a bar is further described below. Weights can be fitted onto first and second weight attachment means 15, 20 in order to increase or decrease the weight of the barbell 10, and consequently increase or decrease the difficulty of the exercise. A worker skilled in the relevant art would appreciate that various types of weights can be fitted onto the first and second weight attachment means 15, 20. First and second slidable handles 25, 30 can be gripped, and allow for lifting the barbell 10 in an upward or downward motion. Said motion is meant to primarily exercise the pectoral, deltoid and back muscles and is commonly referred to as a bench press exercise. First and second slidable handles 25, 30 also slide along the axis of the shaft 35, perpendicular to the lifting field of motion, in such a way so as to create an additional load on the inner pectoral muscles, and deltoid and back muscles.

Figure 2:
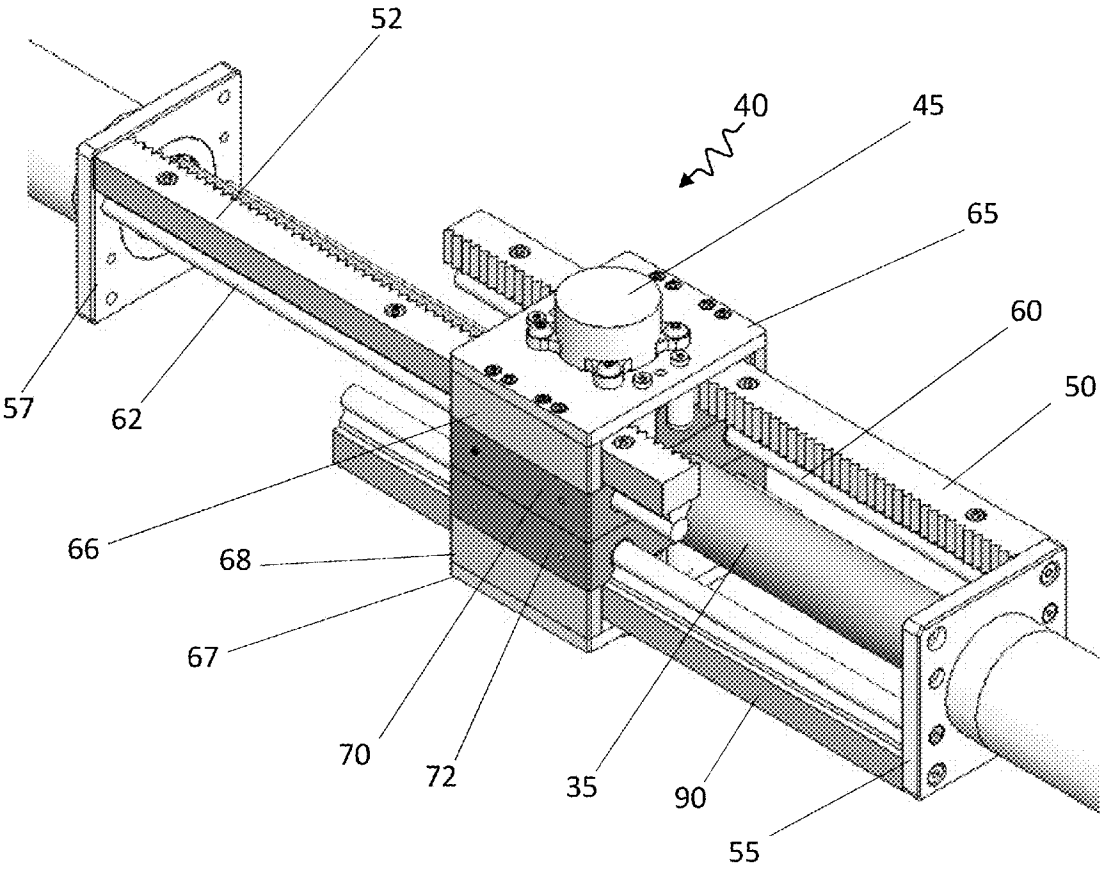
FIG. 2 is a perspective view of a compression-retraction member as installed on a compressible barbell adapter, according to one embodiment of the present invention.

With reference to FIG. 2, the compression-retraction member 40 is shown in greater detail. The compression-retraction member 40 consists of an upper damper 45 operatively connected to first and second upper racks 50, 52, as well as first and second upper guiding rails 60, 62. These parts are mirrored on the underside of the barbell, such that, on the underside of the barbell, there is a similar lower damper, first and second lower racks, and first and second lower guiding rails, all of which are not shown. First and second upper tracks 50, 52, as well as first and second upper guiding rails 60, 62 are fastened to first and second handle flanges, 55, 57 by means of screws, in order to restrict the movement of the first and second slidable handles 25, 30 along the axis of the shaft 35. The upper damper 45 is fastened by means of screws to an upper adapter plate 65, and serves to increase or decrease the force applied to an upper pinion (not shown) such that the rotational movement of the upper pinion (not shown) is made more or less difficult. In turn, the compression or retraction motion of the barbell along the axis of the shaft 35 is restricted, depending on the force of the upper damper 45 and lower damper (not shown) as well. In this embodiment of the invention, the upper damper 45 and lower damper (not shown) are non-adjustable (i.e. fixed) resistances. A worker skilled in the relevant art would appreciate that a number of dampening systems connected to the compression-retraction member could be used, such as upper and lower dampers that have adjustable resistances, or single direction resistances that only apply during a compression or that only apply during a retraction (extension). Alternatively, a worker skilled in the relevant art could appreciate that no dampening system could be used, such that there is a little to no friction and as such the movement in the compression or retraction of the shaft is unforced. The dampers utilized in the present system are well known in the art and are interchangeable with other dampers as known in the art. The lower damper (not shown) is connected to a lower adapter plate 67, and serves the same purpose as the upper damper 45. Both upper and lower adapter plates, 65, 67 are separated from one another via first and second rail supports, 66, 68 as well as first and second clamping blocks 70, 72. Said first and second rail supports 66, 68 are also mirrored on the opposite side of the compression-retraction member, such that there are third and fourth rail supports. Together, first and second rail supports 66, 68 as well as third and fourth rail supports (not shown) serve to encase and guide the first and second upper racks 50, 52 as well as the first lower rack 90 and the second lower rack (not shown). The first rail support 66 and the third rail support (not shown) are both connected to the upper adapter plate 65 and the first clamping block 70, while the second rail support 68 and the fourth rail support (not shown) are both connected to the lower adapter plate 67 and the second clamping block 72. First and second clamping blocks 70, 72 are W-shaped and contain grooves (not shown) which serve to house the first and second upper guiding rails 60, 62 as well as first and second lower guiding rails (not shown). The interaction of the first and second clamping blocks 70, 72 is further detailed below.

Figure 3:
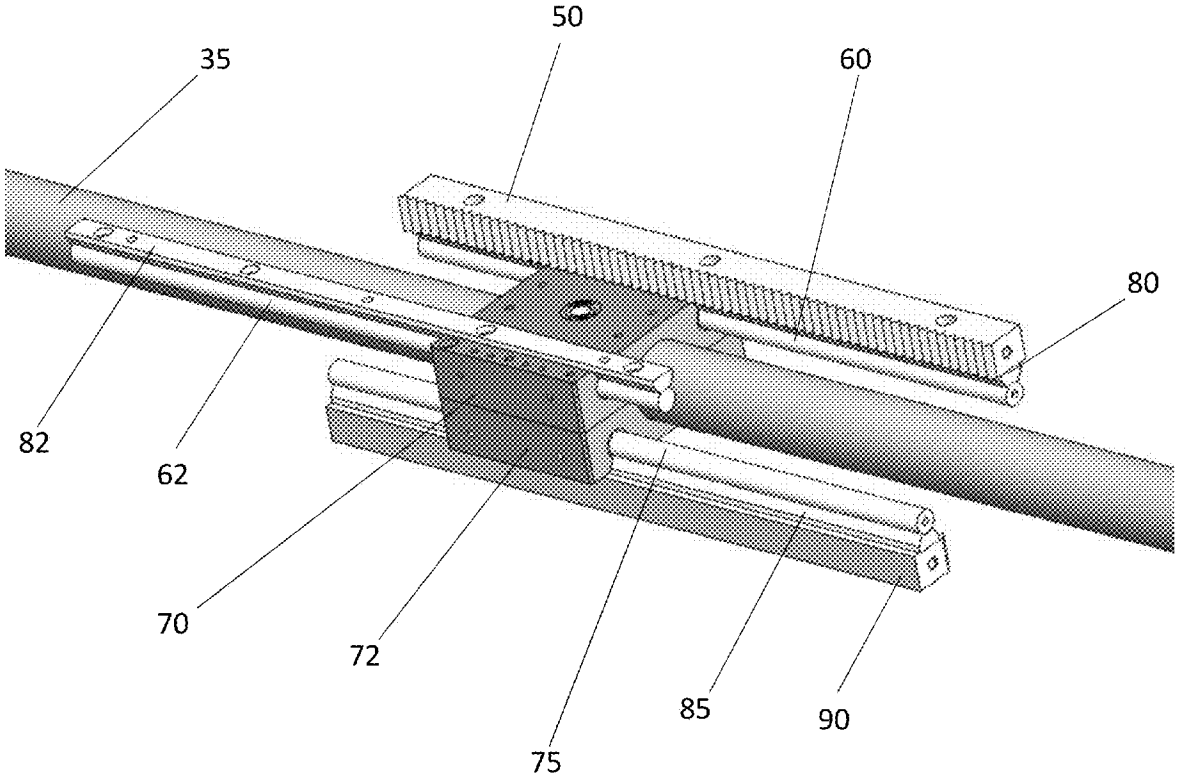
FIG. 3 is a perspective view of guiding rails and racks mounted on clamping blocks as found in the compression-retraction member, according to one embodiment of the present invention.

With reference to FIG. 3, the first and second clamping blocks 70, 72 are shown without the upper damper, the upper adapter plate, second upper rack and the lower adapter plate. The first and second clamping blocks 70, 72 remain connected to the shaft 35, to the first and second upper guiding rails 60, 62 and to the first lower guiding rail 75. First and second upper connecting members 80, 82 are also shown, which serve to create a connection between the first and second upper guiding rails 60, 62 and first upper rack 50 and second upper rack (not shown). The first lower connecting member 85 is also shown, creating a connection between the first lower rack 90 and first lower guiding rail 75. When fitted one on top of the other, first and second clamping blocks 70, 72 create a central aperture that serves to house the shaft 35. The first clamping block 70 has two upper grooves to guide the first and second upper guiding rails 60, 62, while the second clamping block 72 has two lower grooves to guide the first lower guiding rail 75 and the second lower guiding rail (not shown) which is parallel to the first lower guiding rail 75.

Figure 4:
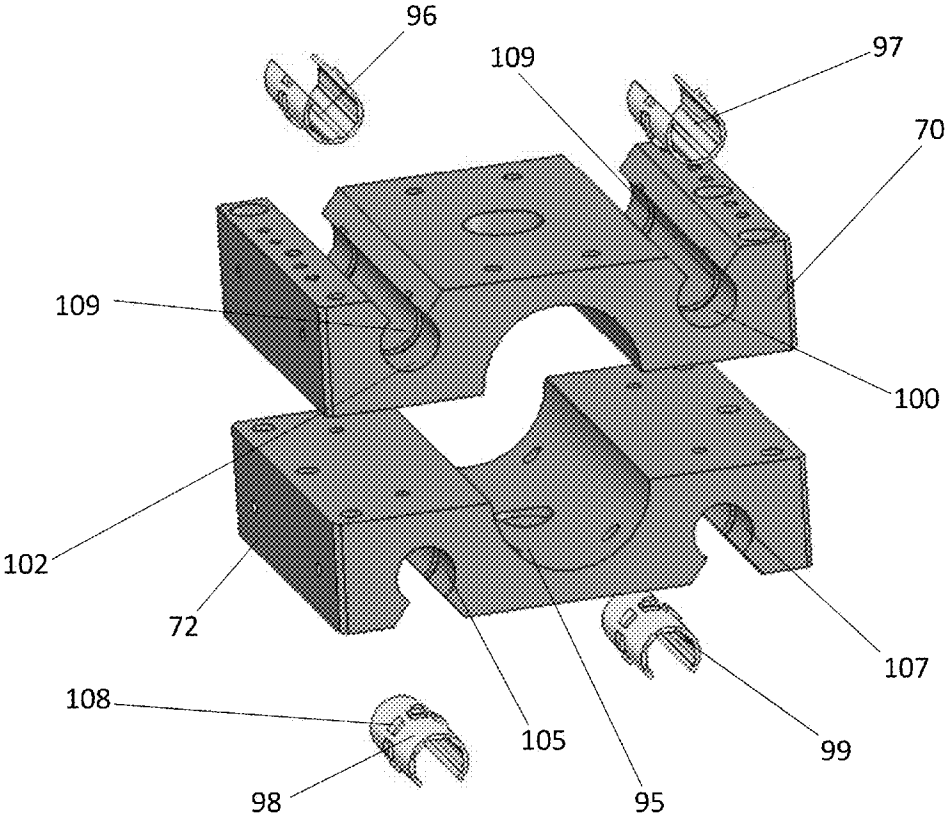
FIG. 4 is an exploded view of upper and lower clamping blocks as installed in a compress-retraction member, according to one embodiment of the present invention.
Figure 5:
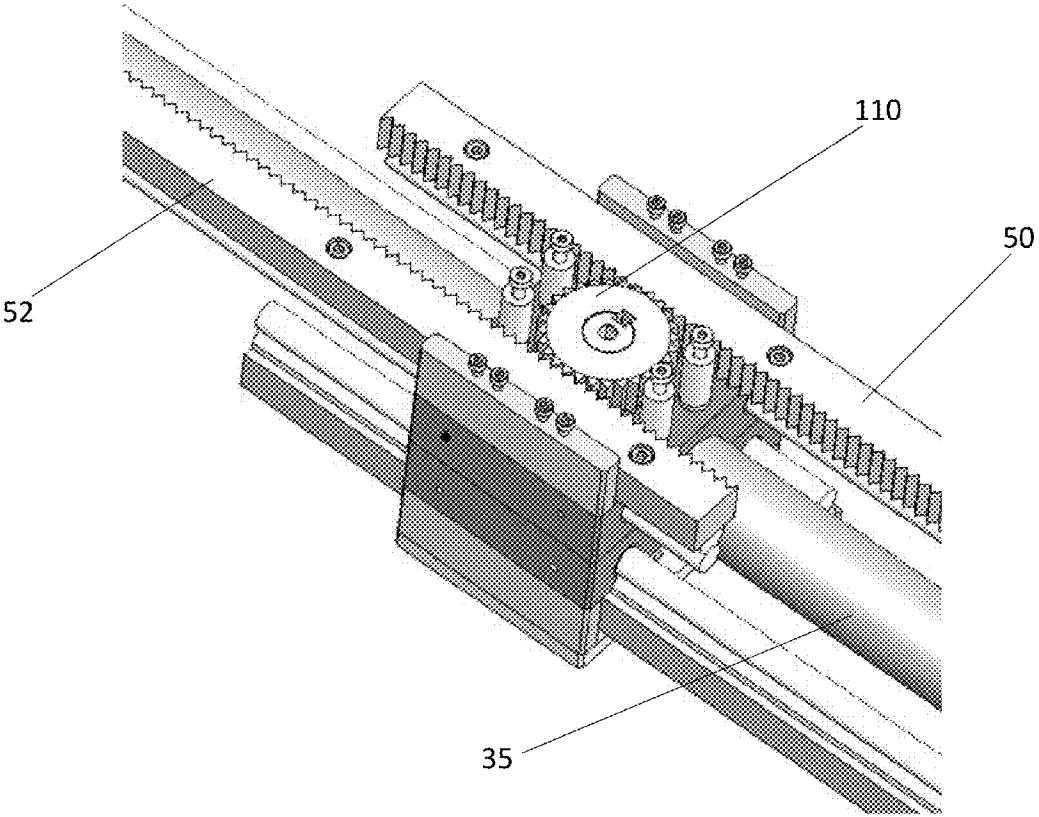
FIG. 5 is a perspective view of a compression-retraction member without an upper damper and upper adapter plate, according to one embodiment of the present invention.
Figure 6:
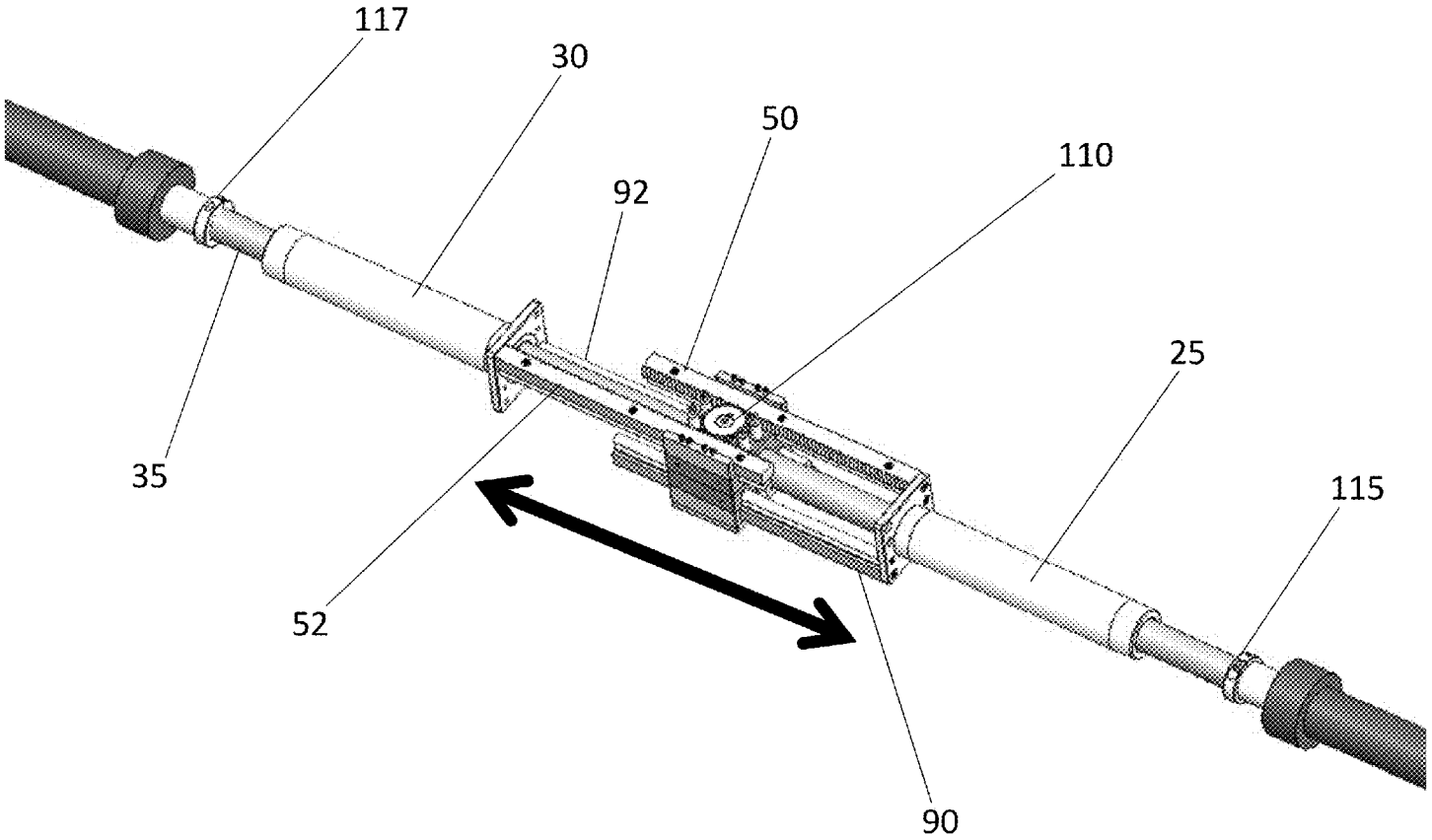
FIG. 6 is a perspective view of a compression-retraction member fastened onto a shaft without the upper damper and upper adapter plate, according to one embodiment of the present invention.

With reference to FIG. 4, the first and second clamping blocks 70, 72 are shown separated one from the other and in greater detail. A central aperture 95 is also shown in greater detail and serves to house the shaft (not shown) of the barbell. First and second upper grooves 100, 102 and first and second lower grooves 105, 107 serve to guide first and second upper guiding rails (not shown) and first and second lower guiding rails (not shown), respectively. Also shown are first, second, third and fourth rail bushings 96, 97, 98, 99, whereby the first rail bushing 96 fits into the first upper groove 100, the second rail bushing 97 fits into the second upper groove 102, the third rail bushing 98 fits into the first lower groove 105 and the fourth rail bushing 99 fits into the second lower groove 107. All rail bushings 96, 97, 98, 99 have indentations 108 that lock into notches 109 within the first and second upper and lower grooves 100, 102, 105, 107. A worker skilled in the relevant art would appreciate that first and second clamping blocks can be made of any material, and will generally have a tape or friction enhancing medium in the center to ensure clamping to the shaft, which in this case are described as rail bushings 96, 97, 98, 99. A worker skilled in the relevant art would also appreciate an alternate embodiment, whereby the clamping blocks could be designed to have a slightly larger central aperture than the shaft, therefore allowing the shaft to move freely within said central aperture. This would require the addition of two collars fastened around the shaft, located on each side of the clamping blocks to prevent the shaft from sliding on either side of the compression-retraction member. This alternate embodiment would allow for a user to rotate the compressible barbell adapter independently of the weights located on the weight attachment means With reference to FIGS. 5 and 6, the compression-retraction member 40 is shown without the upper damper and the upper adapter plate. An upper pinion 110 is shown, connected to both first and second upper racks 50, 52. By adjusting the upper damper (not shown), the ability of the upper pinion 110 to rotate is facilitated or hindered. Consequently, when force is applied from the first and second handles 25, 30 inwards with respect to the axis of the shaft 35, the upper pinion 110 will dictate the ability and ease of the linear movement of the first and second upper racks 50, 52. Said linear movement of the first and second handles 25, 30 is represented by an arrow. The movement of first and second handles 25, 30 and consequently of the compression-retraction member 40, is limited by first and second abutment collars 115, 117. Indeed, the barbell 10 has two extremities of movement. The first is when the first and second handles 25, 30 make contact with the first and second abutment collars 115, 117, respectively. At this moment, the lateral movement along the axis of the barbell 10 is maximally extended, and thus the barbell 10 is in its most retracted position. The second extremity of movement is when the first and second upper racks 50, 52 and first and second lower racks 90, 92, make contact with the second and first handle flanges 55, 57, respectively. At this moment, the lateral movement along the axis of the barbell 10 is minimally extended, and thus the barbell 10 is in its most compressed position. This movement is then further repeated until the exercise is complete. As clearly shown in FIG. 5, one of the key features of the device is that the position of the upper pinion 110 is fixed with respect to the positions of the first and second upper racks 50, 52. In turn, the positions of first and second handles (not shown) are always equidistant with respect to the upper pinion 110. This feature results in enhanced safety when operating the barbell as the first and second handles (not shown) always exert the same force perpendicular to the axis of the shaft 35.

Figure 7:
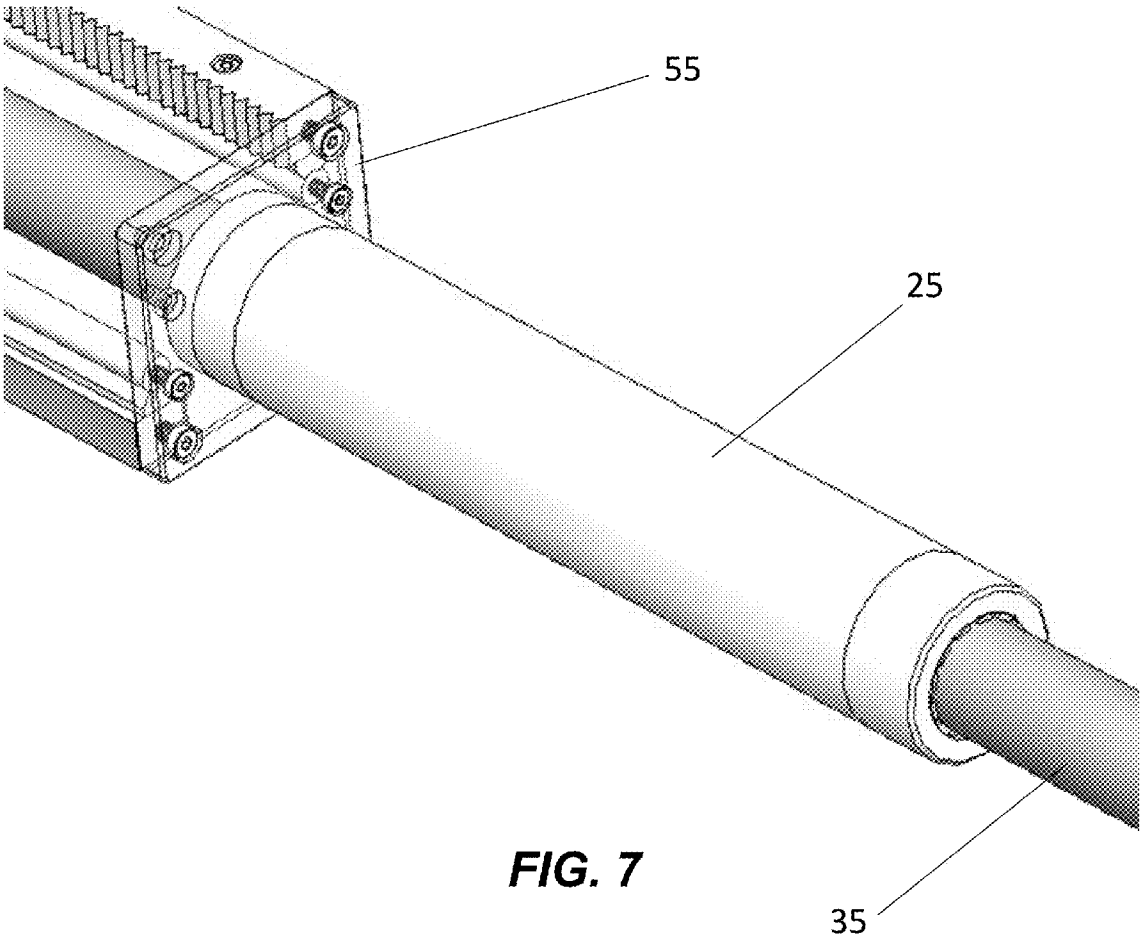
FIG. 7 is a perspective view of a first handle as installed on a compressible barbell adapter, according to one embodiment of the present invention.
Figure 8:
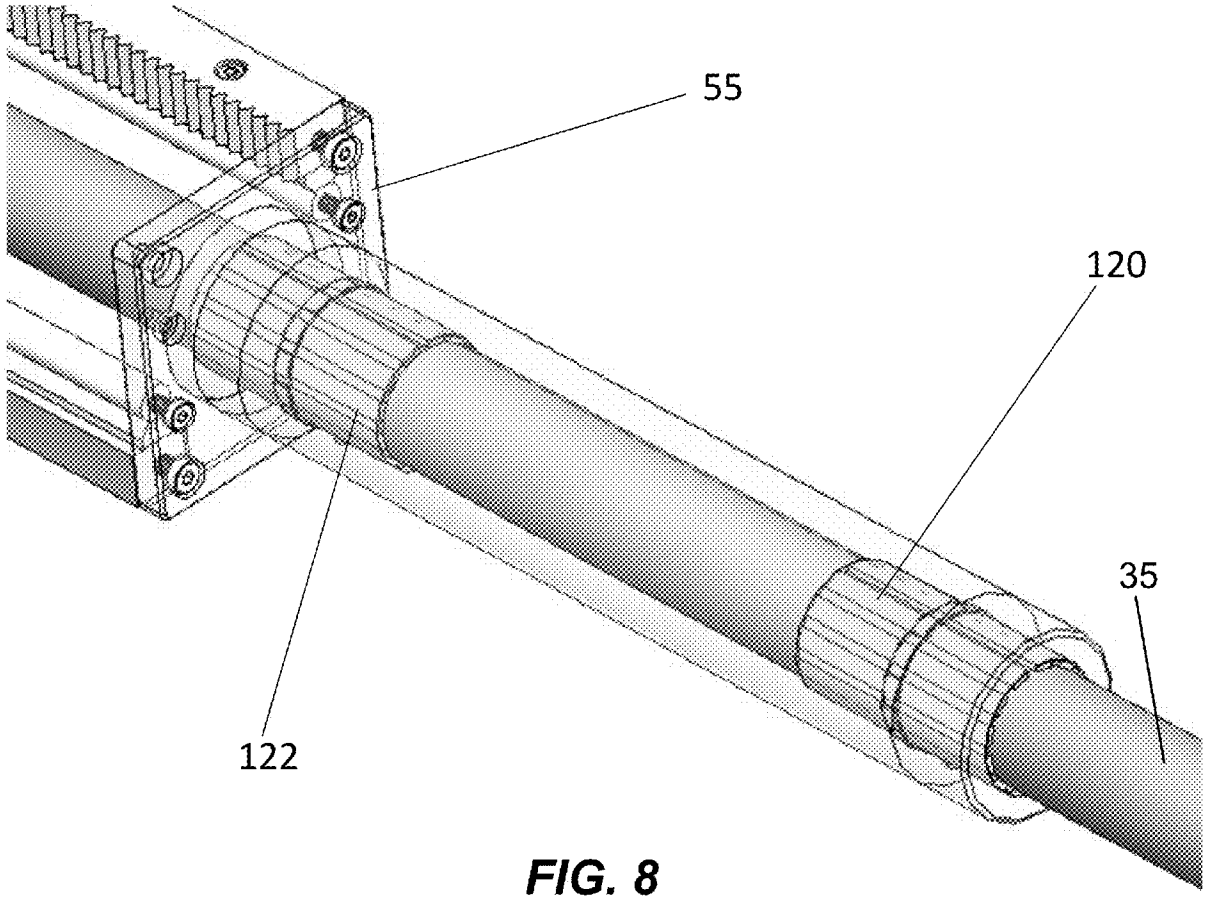
FIG. 8 is a perspective view of a transparent first handle with accompanying bushings, according to one embodiment of the present invention.

With reference to FIGS. 7 and 8, the first handle 25 is shown fastened to the shaft 35 in greater detail. One extremity of the first handle 25 is shown sandwiched between the shaft 35 and the first flange aperture (not shown). The first handle flange 55 thus serves to keep the first handle 25 secured in that position and does not allow a rotational movement of the first handle 25. Additionally, first and second bushings 120, 122 are shown, located at both extremities of the first handle 25, between said first handle 25 and the shaft 35. Said first and second bushings 120, 122 perform the function of further keeping the first handle 25 secured in that position, as well as to allow for easy gliding along the shaft. Identical bushings are located under the second handle (not shown) and serve the same purpose. A worker skilled in the relevant art would appreciate that the easy gliding and motion along the shaft can also be achieved by linear bearings, or a system integrated into the handles themselves based on clearances or other lubrication methods.

Figure 9:
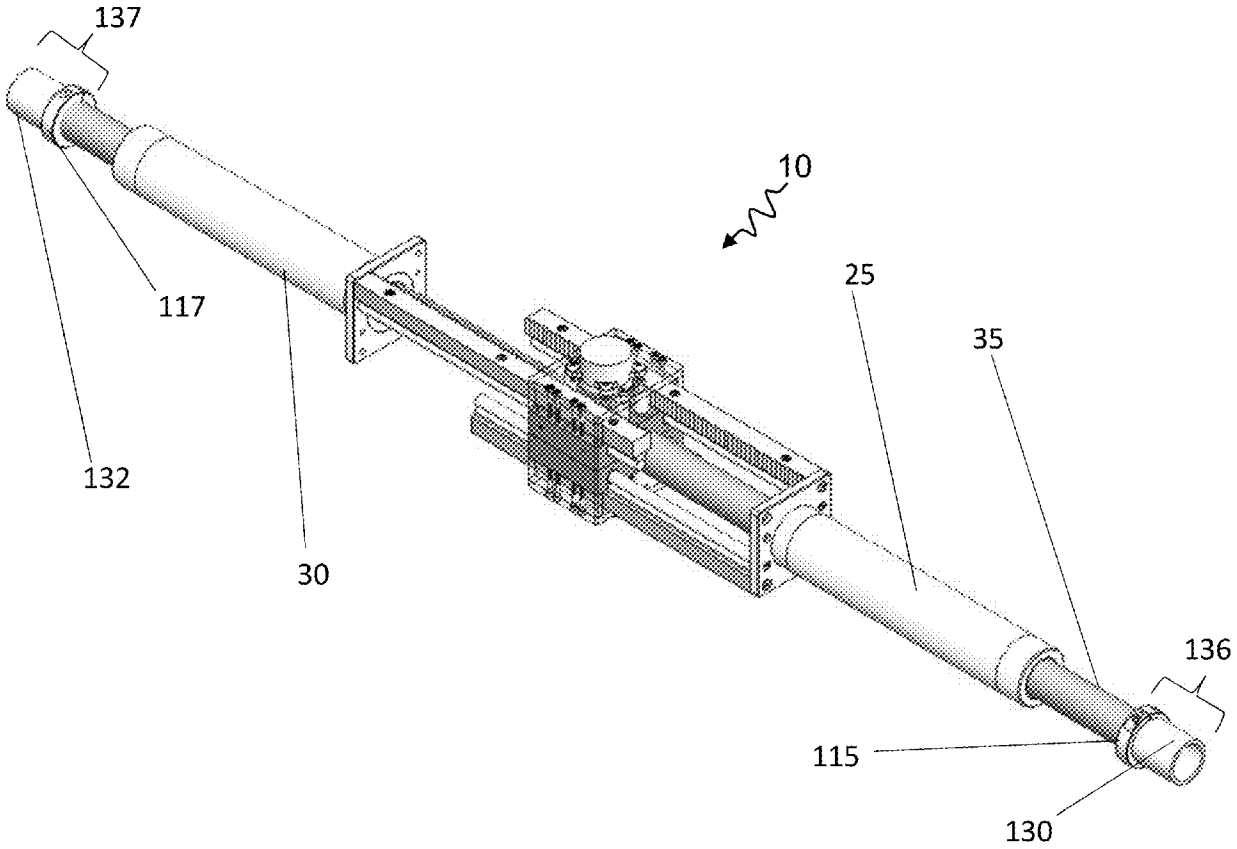
FIG. 9 is a perspective view of a compressible barbell adapter without first and second weight attachment means, according to one embodiment of the present invention.

With reference to FIG. 9, the compressible barbell adapter 10 is shown without the first and second weight attachment means. First and second abutment collars 115, 117 are shown in greater detail, separated from the weight attachment means (not shown) by first and second spacers, 130, 132. Said first and second spacers 130, 132 are hollow and are utilized in order to fit an existing bar (not shown) through the first spacer 130, through the first abutment collar 115, through the shaft 35, and through the second abutment collar 117 and ultimately through the second spacer 132. First and second abutment collars 115, 117 are not only utilized to stop the movement of the first and second handles 25, 30 as described above, but can also be tightened by means of screws around both the shaft 35 and the bar (not shown) to secure said bar (not shown) within its place. A worker skilled in the relevant art would appreciate that while the present embodiment describes first and second abutment collars 115, 117 as separate from first and second corresponding spacers 130, 132, they could be machined as one piece such that first abutment collar 115 would be machined onto first spacer 130 to form first securing means 136, while second abutment collar 117 would be machined onto second spacer 132 to form second securing means 137, as described in FIG. 9.

Figure 10:
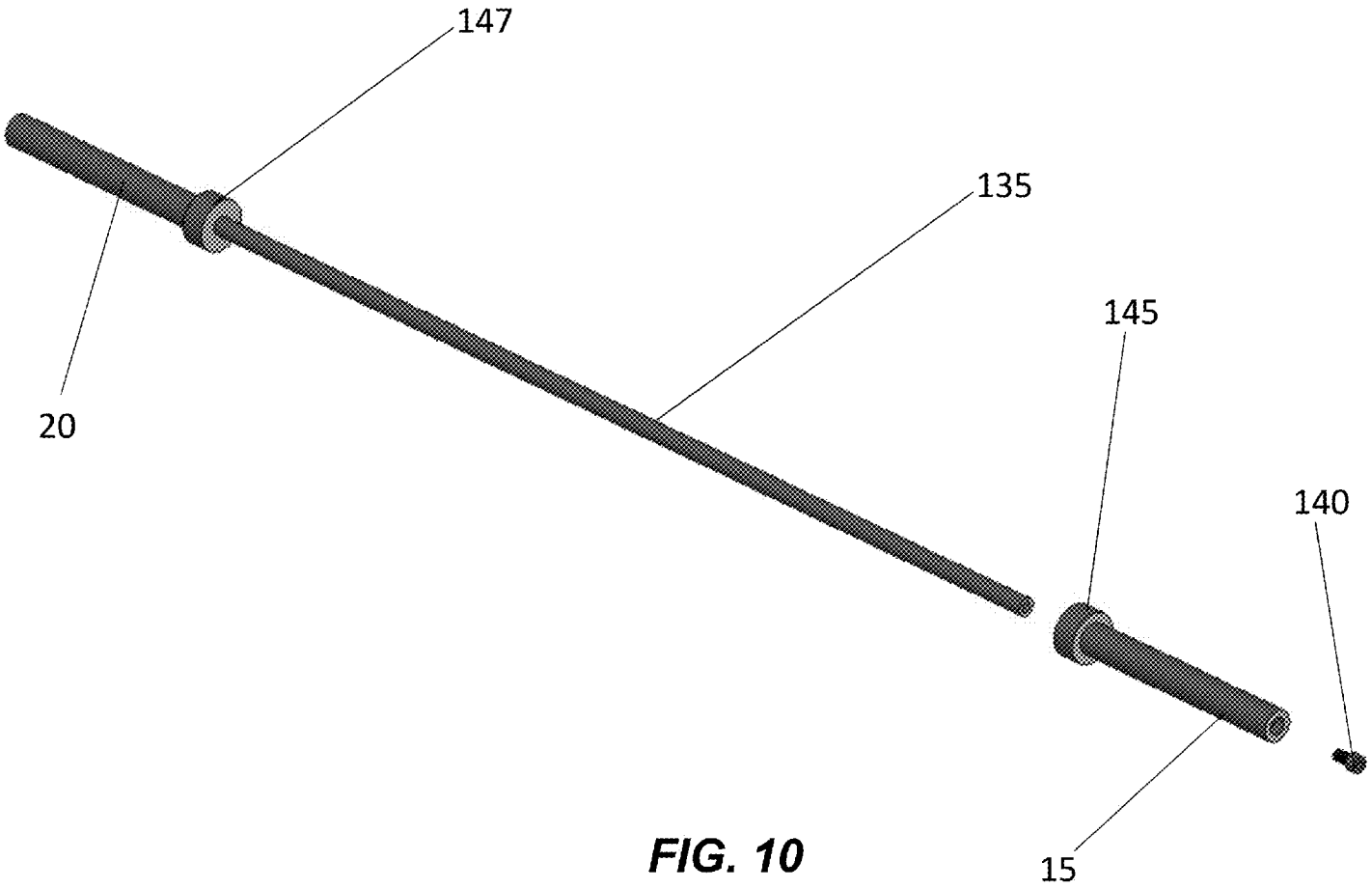
FIG. 10 is a perspective view of a bar and a first weight attachment means unfastened to said bar, according to one embodiment of the present invention.

With reference to FIG. 10, the first weight attachment means 15 is shown removed from a bar 135, while second weight attachment means 20 is still shown connected to said bar 135. In order to fasten or unfasten either of the first or second weight attachment means 15, 20, said first or second weight attachment means 15, 20 needs to be slid onto the bar 135 and screwed in place by means of first screw cap 140 and second screw cap (not shown). A worker skilled in the relevant art would be familiar with first and second stoppers 145, 147, which form part of the first and second weight attachment means 15, 20, respectively and are utilized in order to prevent the weights attached to weight attachment means 15, 20 from sliding too far inward with respect to the center of the bar 135.

Figure 11:
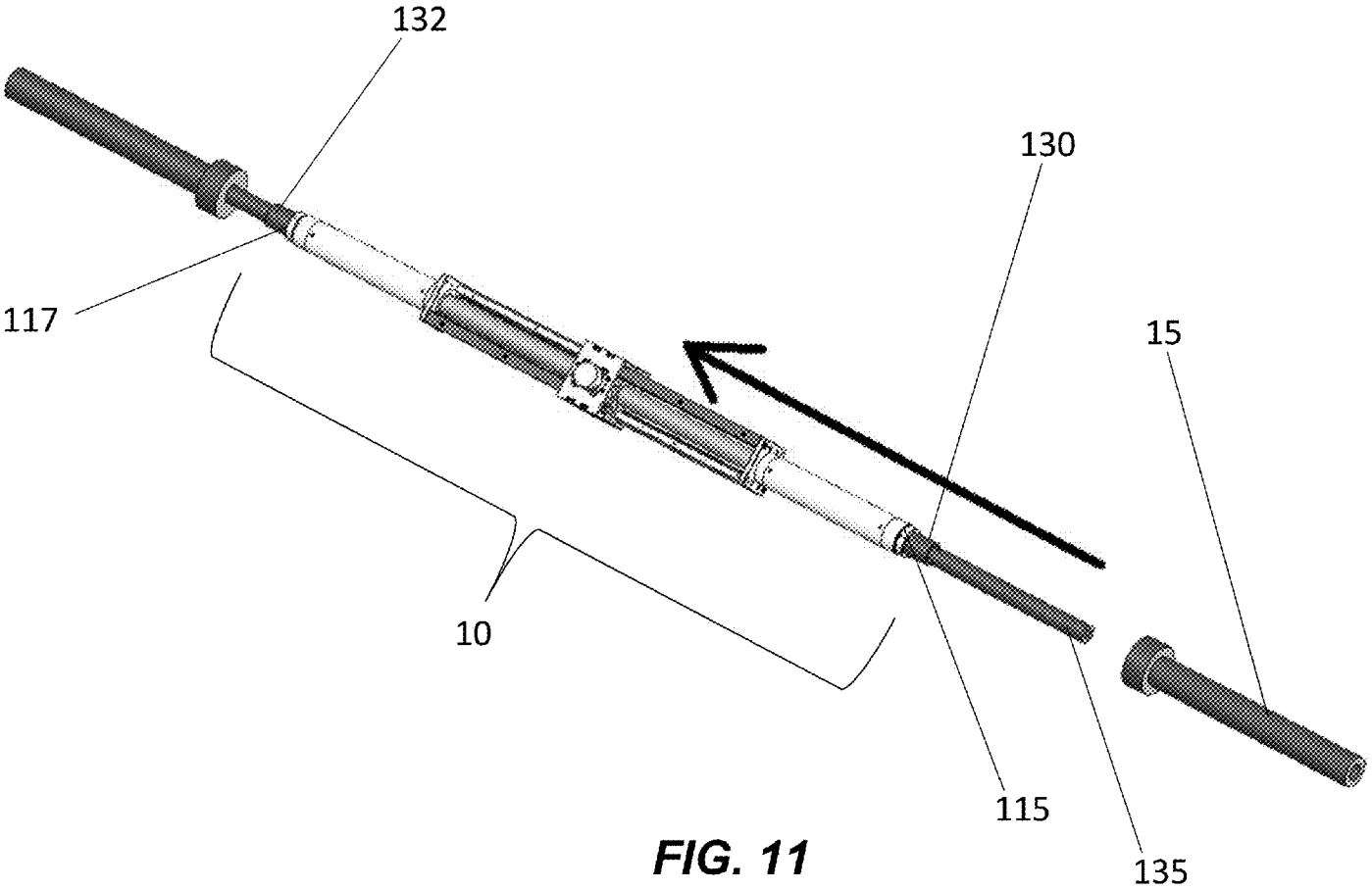
FIG. 11 is a perspective view of a compressible barbell adapter slid onto a bar, according to one embodiment of the present invention.
Figure 12:
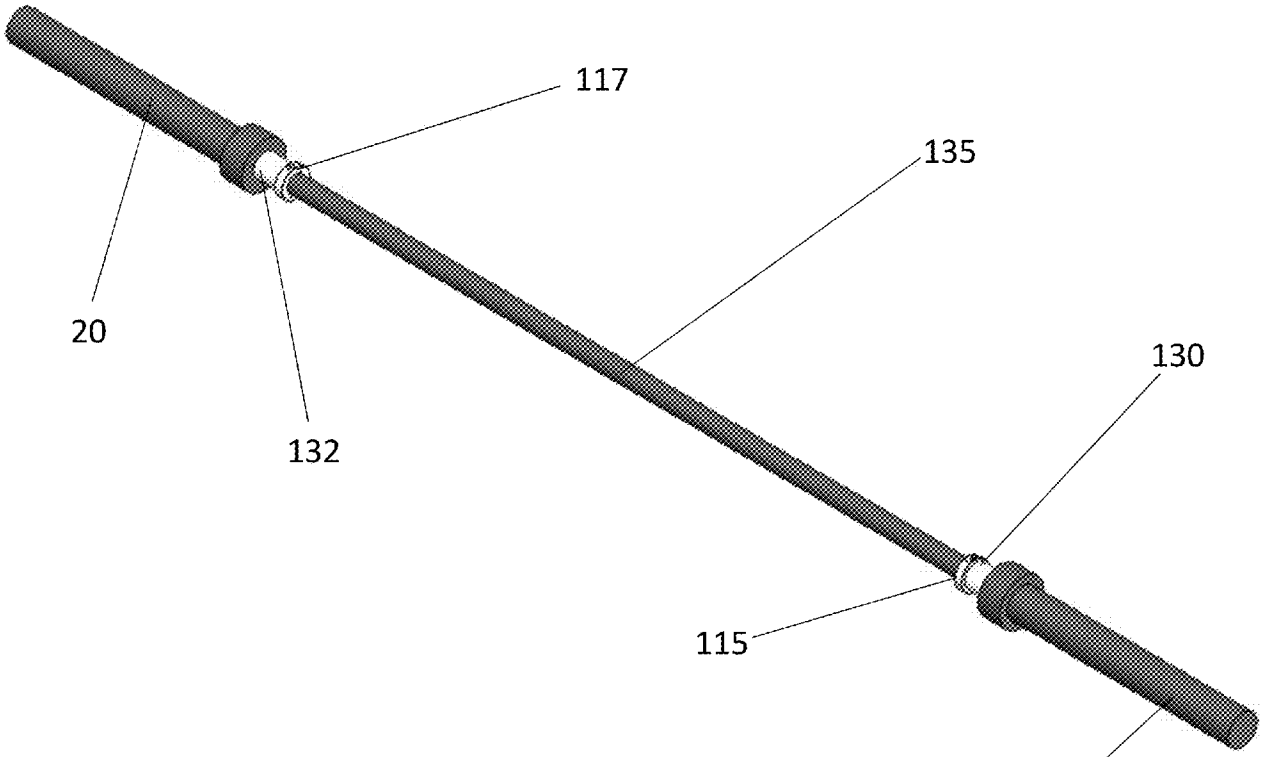
FIG. 12 is a perspective view of a bar fastened to first and second weight attachment, according to one embodiment of the present invention.
Figure 13:
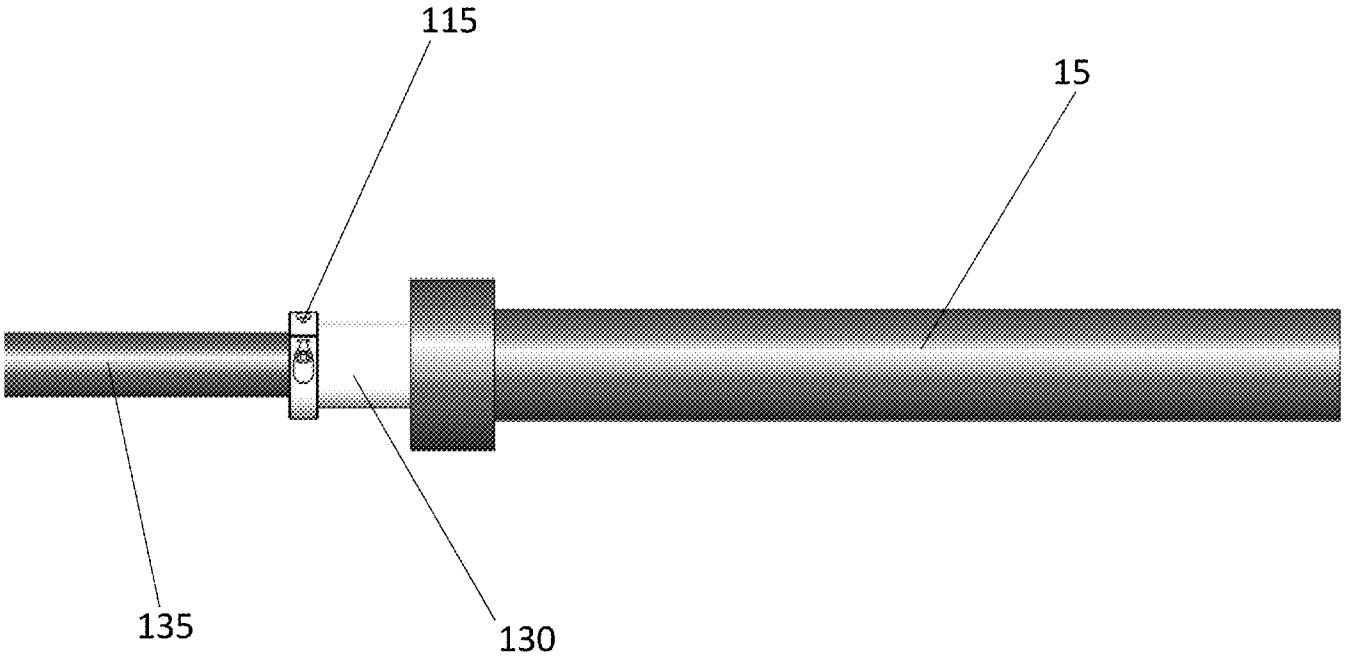
FIG. 13 is a side view of first weight attachment means fastened to the bar, according to one embodiment of the present invention.

With reference to FIG. 11, the compressible barbell adapter 10 is shown slid into place onto the bar 135. The arrow shows the directionality of the movement of the compressible barbell adapter 10. Once the compressible barbell adapter 10 is slid onto the bar 135, the first weight attachment means 15 is also slid back into place, onto the bar 135 and secured in place by first securing cap (not shown). In order to set the compressible barbell adapter 10 into a specific location on the bar 135, the use of first and second abutment collars 115, 117 and first and second spacers 130, 132 is required, the overall functionality of which is further explained below.

With reference to FIGS. 10 and 11, the bar 135 is shown along with first and second spacers 130, 132 and first and second abutment collars 115, 117. As was described above, the compressible barbell adapter (not shown) is slid onto the bar 135, and once the bar 135 is within the hollow tube (not shown), first and second abutment collars 115, 117 are tightened around the hollow tube (not shown) and the bar 135 such that the compressible barbell adapter (not shown) remains in place. The compressible barbell adapter (not shown) can then be utilized in conjunction with any existing bar or with its own bar, should that alternative be preferred.

Figure 14:
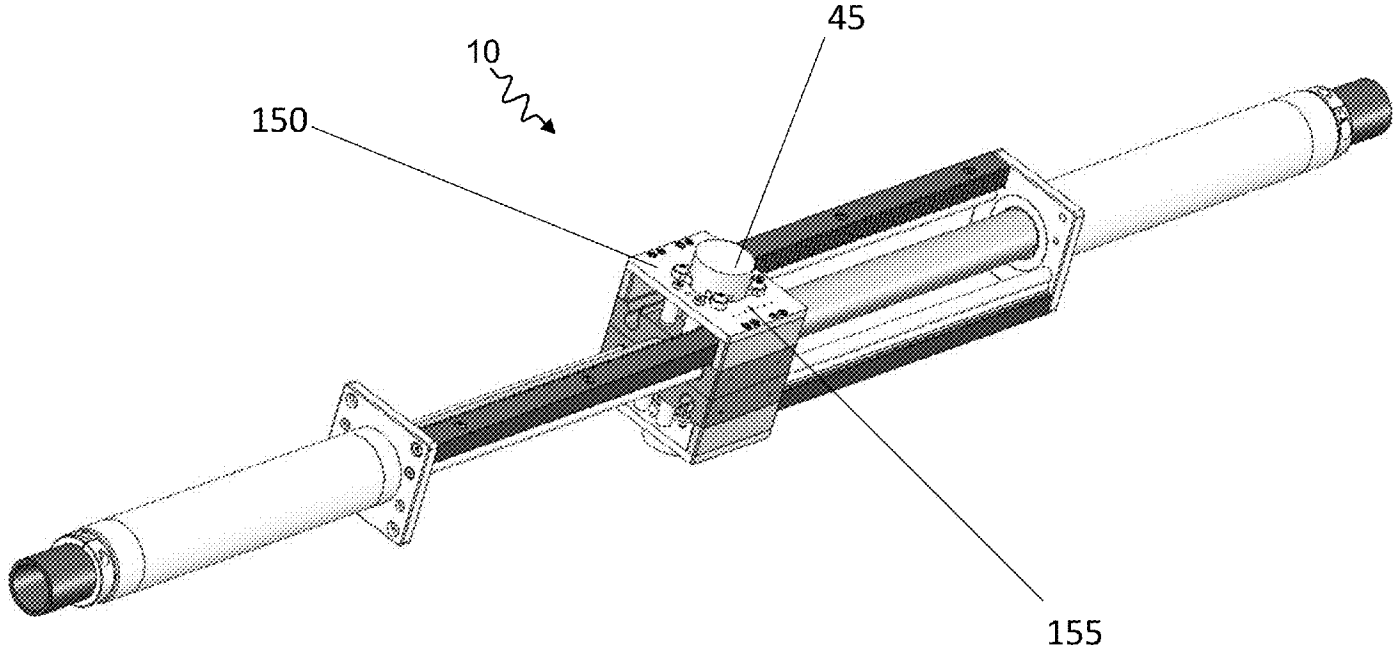
FIG. 14 is a perspective view of an array adapter plate fastened onto the compressible barbell adapter, according to one embodiment of the present invention.

With reference to FIG. 14, a second embodiment of the compressible barbell adapter 10 is shown. Said compressible barbell adapter 10 comprises an array adapter plate 150 that is nearly identical to the adapter plate as was described in the first embodiment, but includes additional features such as an LED array 155. The LED array 155 is meant to be a guide that will illuminate depending on which side the bar is being tilted (i.e. whether the bar is level or not with respect to the ground). The functioning of the LED array 155 is further explained below. In this embodiment, the array adapter plate 150 also includes the damper 45.

Figure 15:
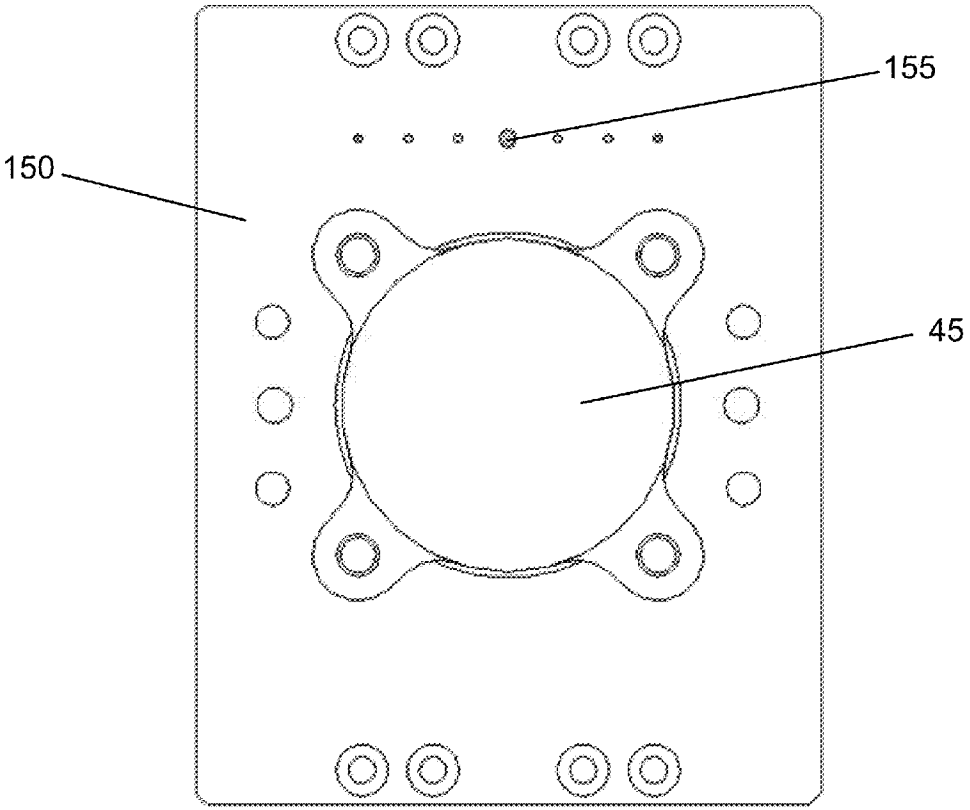
FIG. 15 is a top view of an LED array fastened onto an array adapter plate, according to one embodiment of the present invention.
Figure 16:
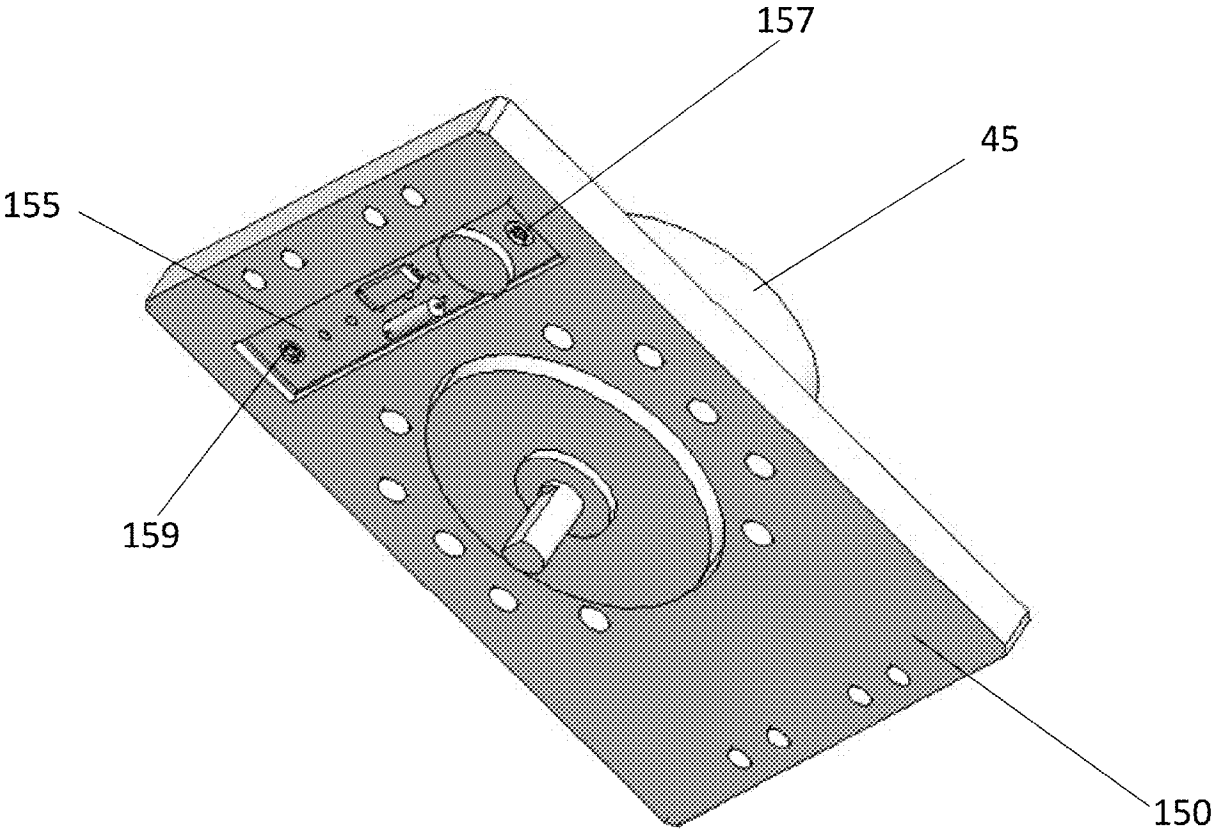
FIG. 16 is a perspective view of an LED array fastened onto an array adapter plate, according to one embodiment of the present invention.

With reference to FIGS. 15 and 16, the LED array 155 is shown fastened onto the array adapter plate 150 in greater detail. The LED array 155 is fastened onto the adapter plate 150 by means of first and second array screws 157, 159. The LED array 155 fits into a cavity (not shown) of the adapter plate 150 such that the adapter plate 150 remains of a similar width as the adapter plate (not shown) of the first embodiment. The damper 45 is still in the same position as it was in the first embodiment.

Figure 17A:
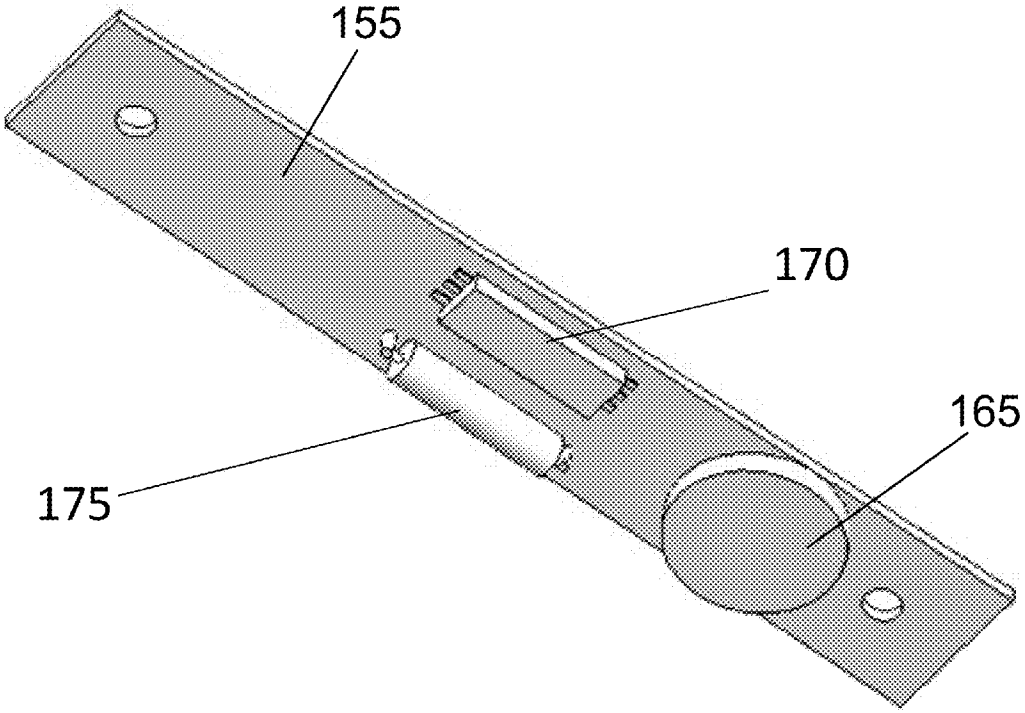
FIG. 17A is a perspective view of an LED array, according to one embodiment of the present invention.
Figure 17B:
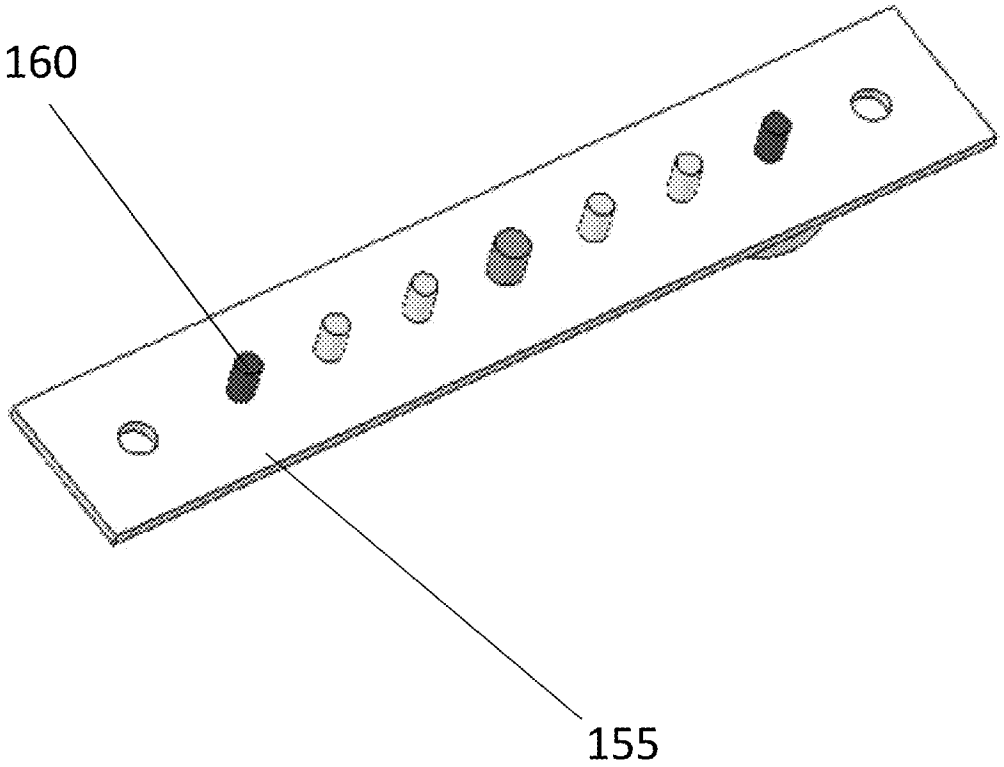
FIG. 17B is another perspective view of an LED array, according to one embodiment of the present invention.

With reference to FIGS. 17*a* and 17*b*, the LED array 155 is shown in greater detail. Also shown are LEDs 160 which light up depending on the level of the bar (not shown) with respect to the ground. A battery 165 serves to power the LED array and the controller 170. In order for the LED array 155 to function properly, the mercury levelling instrument 175 measures the level of the bar (not shown). A worker skilled in the relevant art would be familiar with a mercury levelling instrument 175 or any alternative form of leveller that could be utilized without departing from the scope of the invention. The functioning of the levelling instrument 175 is not necessary for the purposes and scope of the present invention. Based on the position of the mercury in the mercury levelling instrument 175, the controller 170 determines which LED 160 to light up. If the bar is level, the LED 160 at the center of the array will light up, and as the bar becomes more inclined to one side or the other, LEDs 160 will light up one way or another accordingly. In this embodiment, the LED array 155 has 7 LEDs 160, but a worker skilled in the relevant art would appreciate that any other number of LEDs could be utilized to achieve the same effect. Indeed, a worker skilled in the relevant art would be familiar with various types of lighting that could be utilized here without departing from the spirit of the invention, including, but not limited to, a wider or larger LED array, a liquid crystal display (LCD), a plasma display, a laser display, a numeric (digital) display, etc.

Figure 18:
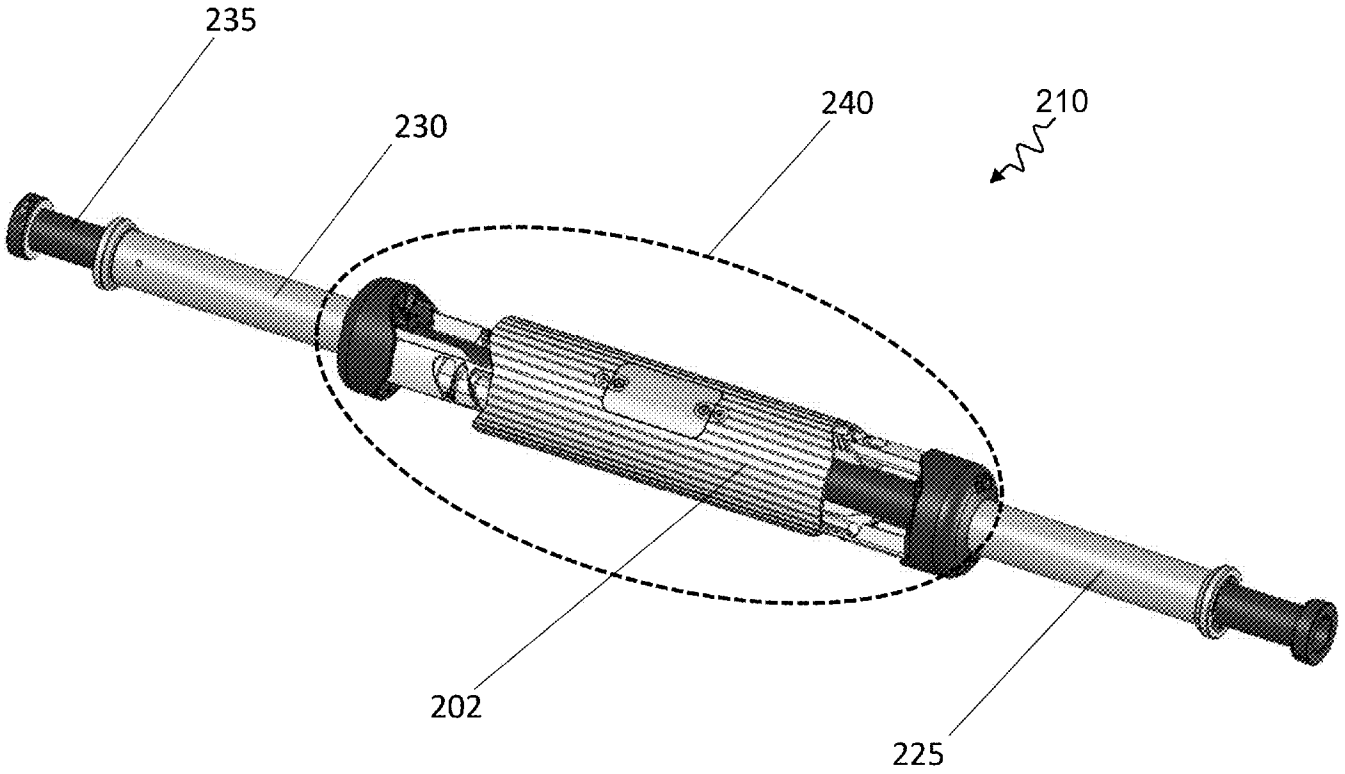
FIG. 18 is a perspective view of a compressible barbell adapter, according to a second embodiment of the present invention.
Figure 19:
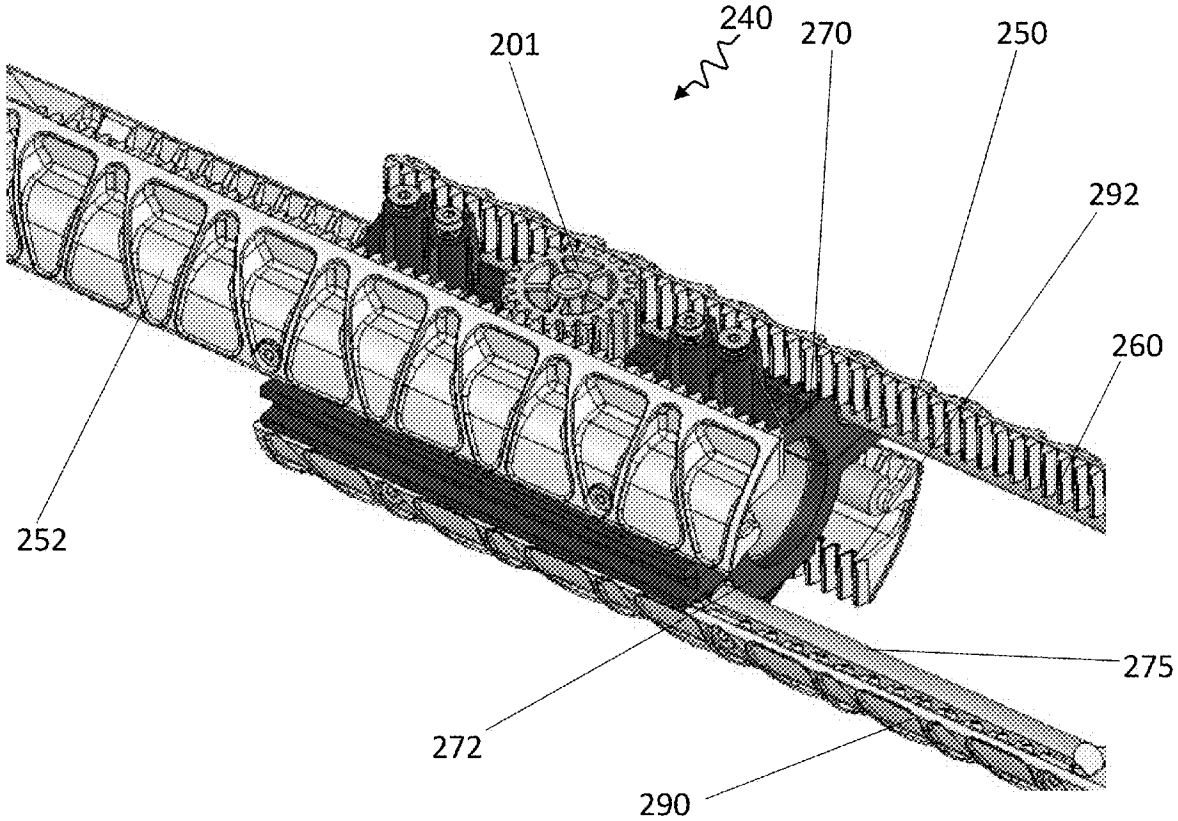
FIG. 19 is a perspective view of a compression-retraction member as installed on a compressible barbell adapter, according to a second embodiment of the present invention.

With reference to FIGS. 18 and 19 and according to a second embodiment of the present invention, a compressible barbell adapter 210 is shown. The second embodiment of the compressible barbell adapter 210 is comprised of first and second slidable handles 225, 230, a hollow shaft 235 and a compression-retraction member 240 located within a cover 202. As was the case in the first embodiment, the compression-retraction member 240 is further comprised of an upper pinion 201 and a lower pinion (not shown), first and second upper racks 250, 252 and first and second lower racks 290, 292. The compression-retraction member 240 is also comprised of first and second clamping blocks 270, 272 as well as first upper guiding rail 260 and second upper guiding rail (not shown) and first lower guiding rail 275 and second lower guiding rail (not shown). In said second embodiment, rail supports that were utilized in the first embodiment of the present invention are not needed as the first and second upper and lower racks 250, 252, 290, 292 have a different shape which enables them to slide effortlessly against the cover 202. Unlike the plastic construction of the compression-retraction member (not shown) of the first embodiment, the compression-retraction member 240 in this second embodiment is now mainly comprised of aluminum components in order to strengthen the compressible barbell adapter 210. The upper and lower dampers have been removed from this particular embodiment; however, a worker skilled in the relevant art would appreciate that said dampers could still be present if necessary, and could act in either a compression only, a retraction only, or both.

A worker skilled in the relevant art would be familiar with additional embodiments of the compression-retraction member, without departing from the spirit of the invention. Indeed, as described above, the system could be easily devised with no dampening system, such that it is only a system of racks and pinions to compress and retract (expand) the barbell. Alternatively, a dampening system could be utilized whereby the resistance of the damper is either fixed (as is the case in the present embodiment) or adjustable. In both aforementioned dampening cases, the resistance applied could be applied in only one direction, such that only the compression or only the retraction of the barbell would offer resistance. Further, a device could easily be devised that would have the dampening system integrated directly into the pinion, such that the pinion itself provides the resistance to the racks. A worker skilled in the relevant art would also appreciate that a locking mechanism could be implemented, such that the rack and pinion system as described above would be locked into place, and no compression or retraction of the barbell is possible while the device is locked. In yet another embodiment, 4 pinion gears could be utilized, spaced around the radial direction of the shaft equally at 90° increments with 4 double-sided gear racks. In this alternative embodiment, each rack would be contacting 2 adjacent gears, but in the same position as described in the present embodiment. This would result in removing the current bushings that serve as guide for the racks. In yet another embodiment, the device could also be devised without the bushings or sliding members as described herein. Indeed, such an embodiment would be possible where the support and guiding functions are replaced by a center clamp and an outer shell of appropriate and corresponding tolerance. In yet another embodiment, the pinion and rack system could be utilized in conjunction with a spring or coil member to offer the appropriate resistance. Indeed, a single motor spring or multiple extension springs with one side fixed to the center clamp and the other fixed to the inside of the rotating gears (pinions) would provide unilateral and constant resistance in both the compression and the retraction of the barbell. In another embodiment, a worker skilled in the relevant art would appreciate that the pinion and rack system utilized could be replaced with a pinion and rack system that would be a friction-based system instead of the indentations as currently disclosed. In other words, the pinions and racks would still be present, but instead of the indentations on the pinion engaging corresponding indentations on the racks, the pinions would consist of a smooth surface that would cause friction with a corresponding surface on the racks.

While the above-mentioned embodiments have described a situation where the compressible barbell adapter is utilized for chest presses and thus the strengthening of the pectoral, deltoid and back muscles, a worker skilled in the relevant art would appreciate that said compressible barbell adapter could also be utilized in the following alternate circumstances: for inclined chest presses, for shoulder exercises in front and behind one's head when seated, pull-ups or chin-ups for back strengthening in front and behind one's head, and push-ups when one grips the handles on the rake or the floor. The general benefit derived from the compressible barbell adapter stems from the fact that the handles are able to slide along the shaft and exactly opposed to a central point on the compression-retraction member.

Although the invention has been described above by reference to certain embodiments of the invention, the invention is not limited to the embodiments described above. Modifications and variations of the embodiments described above will occur to those skilled in the art in light of the above teachings. Moreover, with respect to the above description, it is to be repulsed that the optimum dimensional relationships for the component members of the present invention may include variations in size, material, shape, form, funding and manner of operation.

What is claimed is:

1. A barbell comprising:

first and second slidable handles positioned on the barbell, the first slidable handle having a medial end that is closer to a center of the barbell than a lateral end of the first slidable handle, and the second slidable handle having a medial end that is closer to the center of the barbell than a lateral end of the second slidable handle;

a compression-retraction member positioned on the barbell in between the medial end of the first slidable handle and the medial end of the second slidable handle, the compression-retraction member comprising first and second racks operatively connected to a pinion, the first rack having a medial end that is closer to the center of the barbell than a lateral end of the first rack, and the second rack having a medial end that is closer to the center of the barbell than a lateral end of the second rack, wherein the medial end of the first slidable handle is connected to the lateral end of the first rack and the medial end of the second slidable handle is connected to the lateral end of the second rack for the first and second slidable handles to slide equidistantly along the barbell, and wherein the first and second racks oppose each other such that the medial end of the first rack extends out away from the lateral end of the first rack and towards the second slidable handle, and the second rack extends out away from the lateral end of the second rack and towards the first slidable handle.

2. The barbell of claim 1 further comprising a dampening system connected to the compression-retraction member.

3. The barbell of claim 1 further comprising a cover that includes at least a portion of the compression-retraction member.

4. The barbell of claim 2 whereby the dampening system provides a resistance to the slidability of the first and second slidable handles that is fixed.

5. The barbell of claim 2 whereby the dampening system provides a resistance to the slidability of the first and second slidable handles that is adjustable.

6. A barbell comprising:

first and second slidable handles positioned on the barbell, the first slidable handle having a medial end that is closer to a center of the barbell than a lateral end of the first slidable handle, and the second slidable handle having a medial end that is closer to the center of the barbell than a lateral end of the second slidable handle;

a compression-retraction member that is substantially centrally positioned on the barbell between the first and second slidable handles, the compression-retraction member comprising first and second racks operatively connected to a pinion, the first rack having a medial end that is closer to the center of the barbell than a lateral end of the first rack, and the second rack having a medial end that is closer to the center of the barbell than a lateral end of the second rack, wherein the medial end of the first slidable handle is connected to the lateral end of the first rack and the medial end of the second slidable handle is connected to the lateral end of the second rack for the first and second slidable handles to slide equidistantly along the barbell, and wherein the first and second racks oppose each other such that the medial end of the first rack extends out away from the lateral end of the first rack and towards the second slidable handle, and the second rack extends out away from the lateral end of the second rack and towards the first slidable handle.

7. The barbell of claim 6, further comprising:

a first handle flange; and a second handle flange, wherein the medial end of the first slidable handle is connected to the lateral end of the first rack via the first handle flange, and the medial end of the second slidable handle is connected to the lateral end of the second rack via the second handle flange.

8. The barbell of claim 6, further comprising a dampening system connected to the compression-retraction member.

9. The barbell of claim 6, wherein a portion of the compression-retraction member is encased in a cover.

10. The barbell of claim 6 whereby the dampening system provides a resistance to the slidability of the first and second slidable handles that is fixed.

11. The barbell of claim 6 whereby the dampening system provides a resistance to the slidability of the first and second slidable handles that is adjustable.

12. A barbell comprising:

a first handle and a second handle slidably positioned on the barbell, the first handle having a medial end that is closer to a center of the barbell than a lateral end of the first handle, and the second handle having a medial end that is closer to the center of the barbell than a lateral end of the second handle;

a compression-retraction member positioned in between the medial end of the first handle and the medial end of the second handle, the compression-retraction member comprising a first rack and a second rack operatively connected to a pinion, the first rack having a medial end that is closer to the center of the barbell than a lateral end of the first rack, and the second rack having a medial end that is closer to the center of the barbell than a lateral end of the second rack, wherein the medial end of the first handle is connected to the lateral end of the first rack and the medial end of the second handle is connected to the lateral end of the second rack for the first and second handles to slide along the barbell, and wherein the first rack and the second rack oppose each other such that the medial end of the first rack extends out away from the lateral end of the first rack and towards the second handle, and the second rack extends out away from the lateral end of the second rack and towards the first handle.

* * * * *